US007108164B2

(12) United States Patent
Shima et al.

(10) Patent No.: US 7,108,164 B2
(45) Date of Patent: Sep. 19, 2006

(54) COMBUSTION-POWERED NAIL GUN

(75) Inventors: Yukihiro Shima, Hitachinaka (JP); Yasuki Ohmori, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/281,409

(22) Filed: Nov. 18, 2005

(65) Prior Publication Data

US 2006/0065691 A1 Mar. 30, 2006

Related U.S. Application Data

(60) Division of application No. 10/890,206, filed on Jul. 14, 2004, now Pat. No. 6,983,871, which is a continuation-in-part of application No. 10/637,571, filed on Aug. 11, 2003, now Pat. No. 6,783,045.

(30) Foreign Application Priority Data

Aug. 9, 2002 (JP) ..... 2002-233387
Aug. 9, 2002 (JP) ..... 2002-233388

(51) Int. Cl.
*B25C 1/04* (2006.01)

(52) U.S. Cl. ..... 227/8; 227/2; 227/10; 227/130

(58) Field of Classification Search ..... 227/2, 227/8, 10, 130; 123/46 SC
See application file for complete search history.

(56) References Cited

U.S. PATENT DOCUMENTS 4,403,722 A 9/1983 Nikolich
4,483,280 A 11/1984 Nikolich
4,483,473 A 11/1984 Wagdy
4,483,474 A 11/1984 Nikolich
RE32,452 E 7/1987 Nikolich
5,133,329 A 7/1992 Rodseth et al.
5,485,946 A 1/1996 Jankel
5,671,880 A 9/1997 Ronconi
5,752,643 A 5/1998 MacVicar et al.
5,860,580 A 1/1999 Velan et al.
5,909,836 A 6/1999 Shkolnikov et al.
6,039,231 A 3/2000 White
6,102,622 A 8/2000 Weinger et al.
6,123,241 A 9/2000 Walter et al.
6,145,724 A 11/2000 Shkolnikov et al.
6,223,963 B1 5/2001 Aparacio
6,311,887 B1 11/2001 Walter
6,318,615 B1 11/2001 Walter
6,463,894 B1 10/2002 Hasler et al.
6,520,397 B1 2/2003 Moeller (Continued)

*Primary Examiner*—Scott A. Smith
(74) *Attorney, Agent, or Firm*—Sughrue Mion, PLLC

(57) ABSTRACT

A combustion-powered nail gun drives nails into a workpiece when both a head switch and a trigger switch are turned ON while a safety switch is turned ON. The nail driving operation cannot be performed if the safety switch is not ON even if both the head switch and the trigger switch are ON. The head switch is turned ON when a push lever is urged against the workpiece. Fuel/air mixture in a combustion chamber is ignited when the head switch and the trigger switch are turned ON irrespective of an order in which the head switch and the trigger switch are turned ON, whereby "successive-shot driving" can be performed in which the trigger switch is maintained in its ON position while successively driving a plurality of nails at different locations of the workpiece by repeatedly pushing and releasing the push lever toward and away from the workpiece.

12 Claims, 12 Drawing Sheets

U.S. PATENT DOCUMENTS 6,655,570 B1 12/2003 Shkolnikov et al.
6,715,655 B1 4/2004 Taylor et al.
6,722,550 B1 4/2004 Ricordi et al.
6,739,490 B1 5/2004 Shkolnikov et al.
6,783,047 B1 8/2004 Granacher

COMBUSTION-POWERED NAIL GUN

CROSS-REFERENCE TO RELATED APPLICATION

This is a divisional of application Ser. No. 10/890,206 filed Jul. 14, 2004, now U.S. Pat. No. 6,983,871, which is a continuation-in-part of U.S. application Ser. No. 10/637,571 filed Aug. 11, 2003 and now U.S. Pat. No. 6,783,045. The entire disclosure of the prior applications, application Ser. Nos. 10/890,206 and 10/637,571 are hereby incorporated by reference.

BACKGROUND OF THE INVENTION

1. Field of the Invention

The present invention relates to a combustion-powered nail gun that generates drive force by igniting a fuel/air mixture to drive a fastener such as a nail into a workpiece.

2. Description of the Related Art

U.S. Pat. Nos. 4,403,722, 4,483,280 (Re. 32,452), 4,483,473, and 4,483,474 disclose combustion-powered tool assemblies. FIG. 1 schematically shows configuration of a conventional combustion-powered nail gun 100 similar to that disclosed in these U.S. patents. The nail gun 100 includes a housing 114 to which a handle 111, a tail cover 117, a push lever 121, and a magazine 113 are disposed.

The housing 114 accommodates therein a head cover 123, a combustion chamber frame 115, a cylinder 104, and a piston 110. The combustion chamber frame 115, the head cover 123, and the piston 110 together define a combustion chamber 105. Further, the piston 110 divides the internal space of the cylinder 104 and the combustion chamber frame 115 into upper chamber S2 inclusive of the combustion chamber 105 and a lower chamber S1. The head cover 123 and the cylinder 104 are fixed to the housing 114. The combustion chamber frame 115 is vertically movable within the housing 114 as guided by the housing 114 and the cylinder 104. The upper end of the combustion chamber 115 can be seated on the head cover 123 to provide the sealed combustion chamber 105. Although not shown in the drawing, a connection rod linkingly connects the combustion chamber frame 115 with the push lever 121 so that the combustion chamber frame 115 and the push lever 121 move together in an interlocking relation to each other.

Further, a spring (not shown) is provided for urging the push lever 121 downward. Therefore, the push lever 121 and the combustion chamber frame 115 are urged downwardly while no force operates against the urging force of the spring. At this time, because the head cover 123 and the cylinder 104 are fixed, an inlet (not shown) is opened between the head cover 123 and a top end of the combustion chamber frame 115, and an outlet (not shown) is opened between the upper outer peripheral portion of the cylinder 104 and the combustion chamber frame 115. Although not shown in the drawing, annular seals for forming tight seals at the inlet and the outlet are provided at the lower end of the head cover 123 and the upper end of the cylinder 104. Further, an intake vent (not shown) is provided in the upper end of the housing 114, and a discharge vent (not shown) is provided in the lower end of the housing 114.

The housing 114 further accommodates a motor (not shown), a spark plug 109 in a space above the head cover 123. Further, a fuel canister 107 holding a fuel is disposed in the housing 114. An injection port (not shown) connects the fuel canister 107 for supplying combustible gas from the fuel canister 107 into the combustion chamber 105. A fan 106 is disposed in the combustion chamber 105. The fan 106 is attached to and rotated by the drive shaft of the motor (not shown). Electrodes of the spark plug 109 are exposed to the combustion chamber 105. Ribs 124 are provided on the inner surface of the combustion chamber frame 115 so as to protrude radially inwardly of the combustion chamber 105.

A seal ring (not shown) is held at an outer peripheral surface of the piston 110 so as to be slidably movable with respect to the cylinder 104. A bumper (not shown) is provided in the cylinder 104 and below the piston 110 for absorbing excessive energy of the piston 110 after a nail driving operation. Also, an exhaust hole (not shown) is formed in the cylinder 104. A check valve (not shown) of well-known construction is provided on the outer side of the exhaust hole. A driver blade 116 extends from the piston 110 toward the tail cover 117 for driving a nail. A trigger switch spring 112A is connected to the trigger switch 112 for biasing the trigger switch 112 toward its OFF position.

The handle 111 is attached to a middle section of the housing 114. A trigger switch 112 is provided on the handle 111. The trigger switch 112 is biased by a trigger switch spring 112A for urging the trigger switch 112 toward its OFF position. Each time the trigger switch 112 is pulled (turned ON), the spark plug 109 generates a spark if the sealed combustion chamber 105 is provided.

The magazine 113 and the tail cover 117 are attached to the lower end of the housing 114. The magazine 113 is filled with nails (not shown). The magazine 113 feeds the nails one at a time to the tail cover 117. The tail cover 117 sets the nails fed from the magazine 113 in a position below the driver blade 116 and guides movement of the nails when the nails are driven downward by the driver blade 116 into a workpiece W.

A mechanism 200 for maintaining closing state of the combustion chamber 105 is provided. The mechanism 200 includes a trigger switch bracket 201 extending from the trigger switch 112, a rod 202 extending from the combustion chamber frame 115, and a cam 203. The trigger switch bracket 201 has a lower end provided with a pivot pin 205. The cam 203 has a slot opening 206 engaged with the pivot pin 205. The cam 203 is pivotally connected to the housing 114 by a pivot bush 207, and has a first stop surface 208 selectively engageable with a lower end of the rod 202. Further, the cam 203 has a second stop surface 209 for preventing manipulation of the trigger switch 112.

When the combustion chamber frame 115 is separated from the head cover 123 by the biasing force of the spring, the rod 202 is positioned beside the second stop surface 209, so that counterclockwise pivotal movement of the cam 203 is prevented, thereby preventing upward movement of the trigger switch 112. When the combustion chamber frame 115 is seated onto the head cover 123, the rod 202 is moved away from the second stop surface 209, so as to allow counterclockwise movement of the cam 203. In this state, if the trigger switch 112 is pulled upwardly (turned ON) against the biasing force of the trigger switch spring 112A, the cam 203 is pivotally moved in the counterclockwise direction, so that the lower end of the rod 202 can be seated on the first stop surface 208. As a result, downward movement of the combustion chamber frame 115 is prevented by the abutment between the rod 202 and the first stop surface 208.

If the tool 100 is moved away from the workpiece W and if the trigger switch 112 is released, the cam 203 can be piviotally moved in a clockwise direction by the biasing force of the trigger switch spring 112A, so that the lower end of the rod 202 slides over the first stop surface 208, and can be positioned beside the second stop surface 209.

In the conventional combustion-powered nail gun, the piston 110 is moved to its lower dead center as a result of combustion, and the piston 110 is returned to its original upper dead center by the pressure difference between the upper chamber S2 and the lower chamber S1. After the combustion, negative pressure is generated in the upper chamber S2 because high pressure combustion gas is discharged through the exhaust hole and the check valve and because heat of the combustion chamber 105 is gradually absorbed into the cylinder 104 and the combustion chamber frame 115 to lower the internal pressure. This is generally referred to as "thermal vacuum". On the other hand, atmospheric pressure is applied in the lower chamber S1. Thus, the piston 110 can be moved toward its upper dead center. If the nail gun 100 is moved away from the workpiece W when the piston 110 has reached its upper dead center, the combustion chamber 105 is open to atmosphere. Combustion gas remaining in the combustion chamber 105 is expelled out of the combustion chamber 105 and fresh air is introduced into the combustion chamber 105 by virtue of the fan 106, whereby next nail driving operation can be performed.

In the conventional combustion-powered nail gun 100, the combustion chamber 105 is incapable of being open to atmosphere until the trigger switch 112 is turned OFF. When the nail gun 100 is moved away from the workpiece W, the lower end of the rod 202 is brought into abutment with the first stop surface 208 if the trigger switch 112 is maintained in its ON position. That is, provided that the trigger switch 112 is not released, the rod 202 and the combustion chamber frame 115 do not make downward movement, so that the combustion chamber 105 is maintained in a sealed condition. As such, it is impossible for the conventional nail gun to perform "successive-shot driving" in which the trigger switch is maintained in its ON position while successively driving a plurality of nails at different locations of the workpiece by repeatedly pushing and releasing the push lever toward and away from the workpiece.

U.S. Pat. No. 5,133,329 discloses an ignition system applied to the combustion-powered nail gun. In the ignition system disclosed therein, a head switch is provided for detecting that the nail gun is brought into abutment with the workpiece. The fuel/air confined in the combustion chamber is ignited when the trigger switch is turned ON while the head switch is ON. However, ignition to the fuel/air is prohibited when the trigger switch is turned ON while the head switch is OFF.

According to the ignition system disclosed in U.S. Pat. No. 5,133,329, while it is possible to perform a so-called "one-shot driving" in which a nail driving operation is performed each time the trigger switch is pushed and then released, it is also impossible to perform the "successive-shot driving".

SUMMARY OF THE INVENTION

In view of the foregoing, it is an object of the present invention to provide a combustion-powered tool that is capable of performing successive-shot driving.

Another object of the present invention is to provide a combustion-powered tool that is easy to use and safeguarded from accidental driving of the tool;

Yet another object of the present invention is to provide a combustion-powered tool that does not dissipate energy of a built-in battery in vain.

To achieve the above and other objects, there is provided, according to one aspect of the invention, a combustion-powered tool for driving a fastener into a workpiece, that includes a combustion chamber, a spark plug, a drive blade, a first switch, a second switch, and a control unit. The combustion chamber is selectively opened to atmosphere and closed to be hermetically sealed. Fuel is introduced into the hermetically sealed combustion chamber to fill the combustion chamber with a fuel/air mixture. The spark plug is exposed to the combustion chamber for igniting the fuel/air mixture within the hermetically sealed combustion chamber. Inner pressure of the combustion chamber increases when the fuel/air mixture is ignited within the hermetically sealed combustion chamber. The driver blade is moved in accordance with the increase in the inner pressure of the combustion chamber, and the fastener is driven into the workpiece caused by the increase in the inner pressure of the combustion chamber. The first switch produces a first signal when a condition in which the combustion chamber is hermetically sealed is detected. The second switch produces a second signal when the second switch is manipulated by an operator. The control unit controls the spark plug to ignite the fuel/air mixture when both the first switch and the second switch are operated irrespective of an order in which the first switch and the second switch are operated.

According to another aspect of the invention, there is provided a combustion-powered tool for driving a fastener into a workpiece, that includes a combustion chamber, a fan, a spark plug, a drive blade, a first switch, a second switch, a third switch, a battery, and a control unit. The combustion chamber is selectively opened to atmosphere and closed to be hermetically sealed. Fuel is introduced into the hermetically sealed combustion chamber. The fan is rotatably disposed inside the combustion chamber for mixing the fuel with air to fill the combustion chamber with a fuel/air mixture. The spark plug is exposed to the combustion chamber for igniting the fuel/air mixture within the hermetically sealed combustion chamber. The inner pressure of the combustion chamber increases when the fuel/air mixture is ignited within the hermetically sealed combustion chamber. The driver blade is moved in accordance with the increase in the inner pressure of the combustion chamber, the fastener being driven into the workpiece caused by the increase in the inner pressure of the combustion chamber. The first switch produces a first signal when a condition in which the combustion chamber is hermetically sealed is detected. The second switch produces a second signal when manipulated by an operator. The third switch is selectively turned ON and OFF. The battery is connected to the fan and the spark plug. The control unit controls the spark plug to ignite the fuel/air mixture when both the first switch and the second switch are operated while the third switch is turned ON. The control unit controls the spark plug to inhibit igniting the fuel/air mixture when the third switch is turned OFF.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 2A:
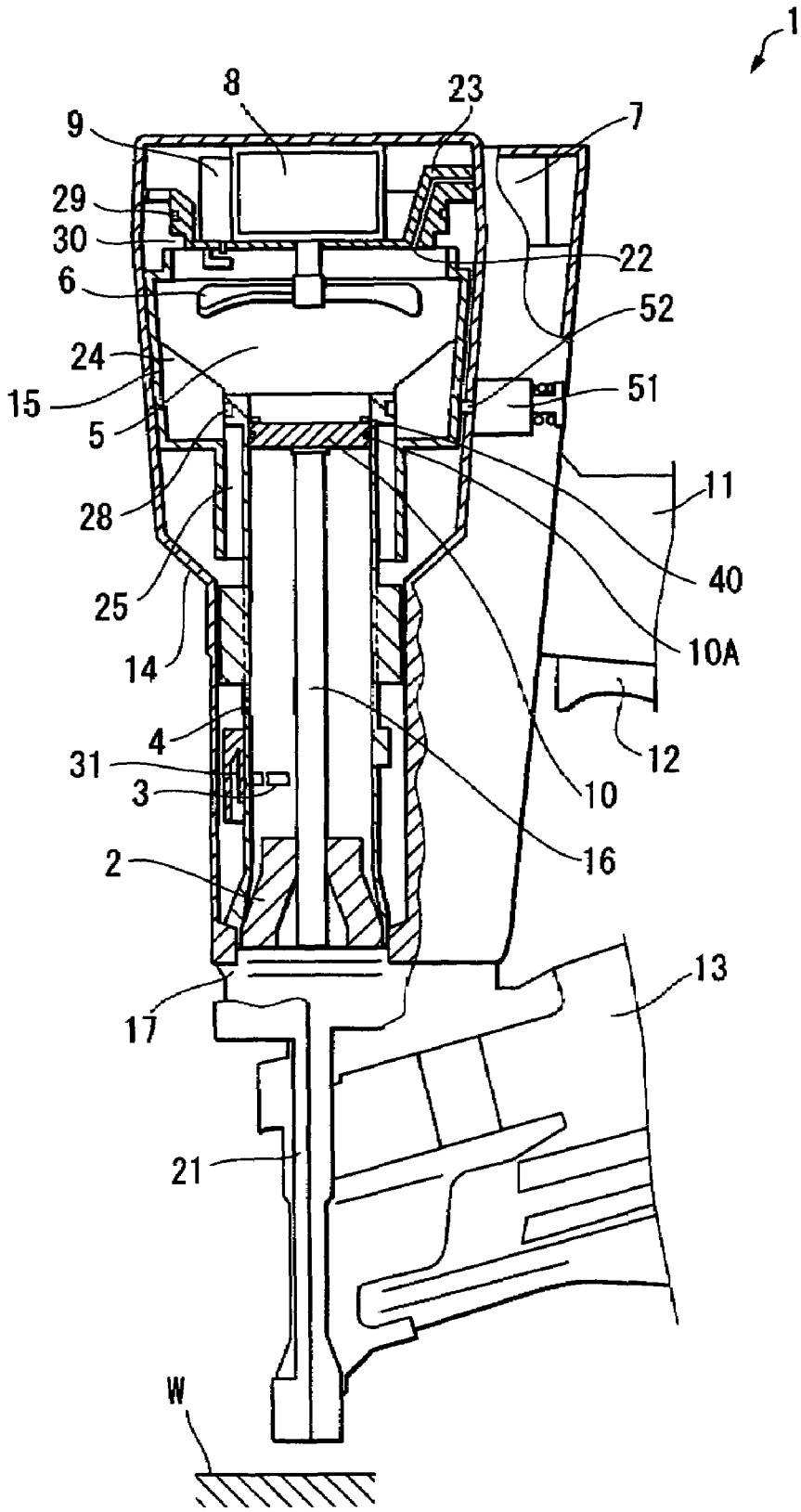
FIG. 2A is a partial cross-sectional view showing the combustion-powered nail gun according to a first embodiment of the present invention wherein a plunger is retracted to a housing side.
Figure 2B:
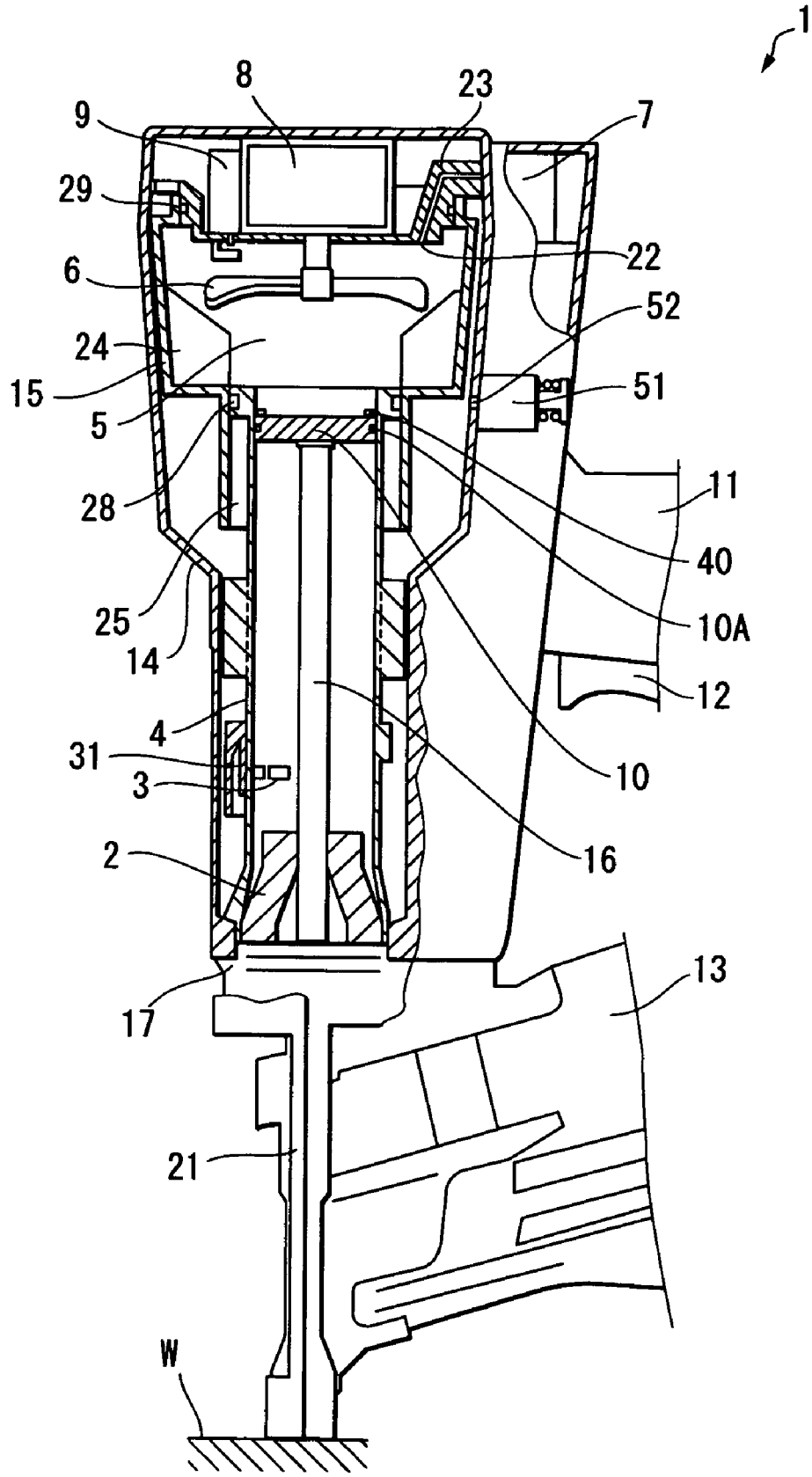
FIG. 2B is a partial cross-sectional view showing the combustion-powered nail gun according to the first embodiment of the present invention wherein the push lever is pressed against a workpiece.
Figure 2C:
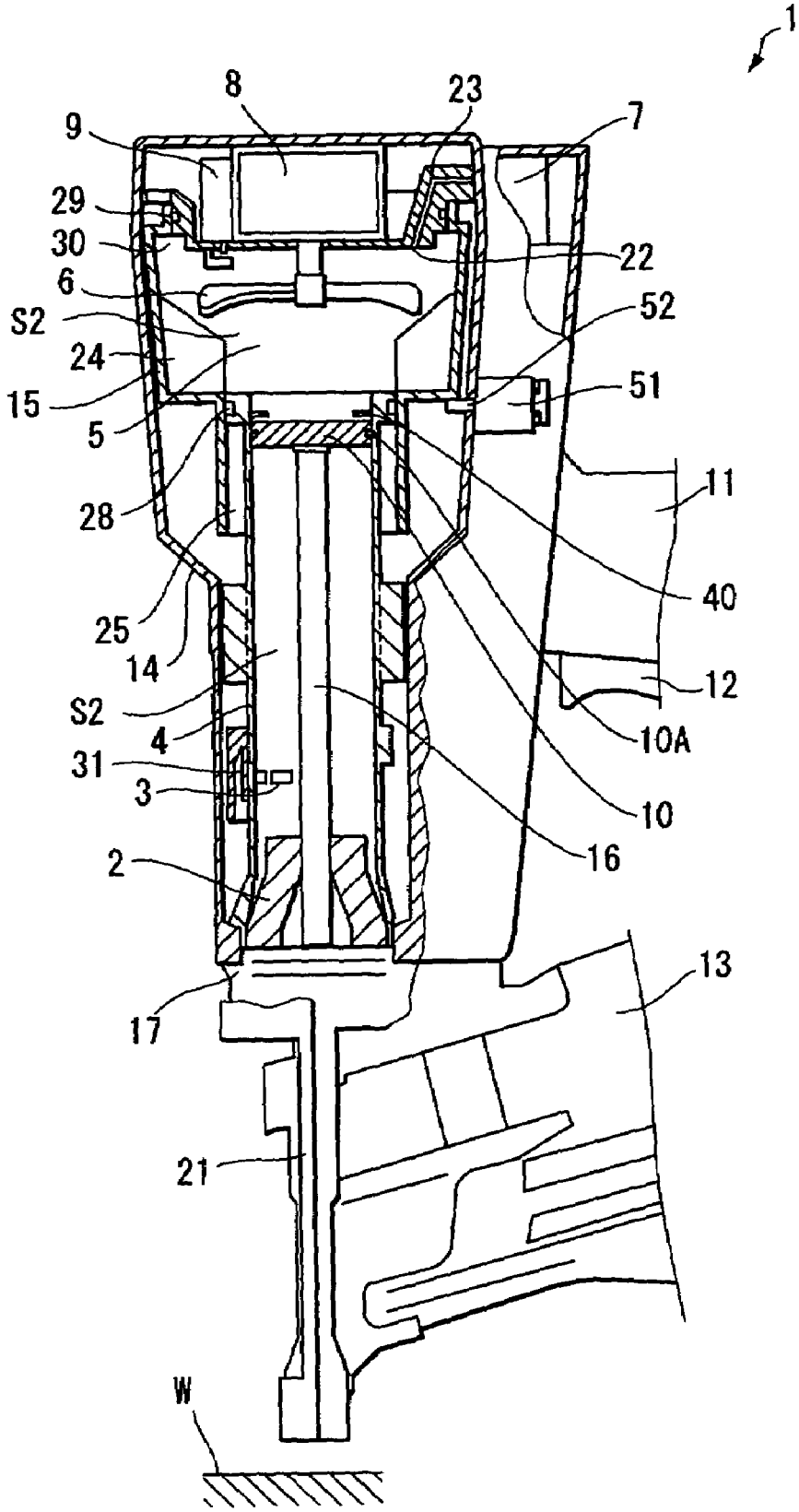
FIG. 2C is a partial cross-sectional view showing the combustion-powered nail gun according to the first embodiment of the present invention wherein the plunger is projected inwardly.

Referring to FIGS. 2A through 2C, a combustion-powered nail gun according to a preferred embodiment of the present invention will be described. In the following description, it is assumed that the nail gun is held in a state in which the nails are shot downward and the terms "upward", "downward", "upper", "lower", "above" and "below" and the like will be used throughout the description to describe various elements when the combustion-powered nail gun is held in such a state.

Figure 1:
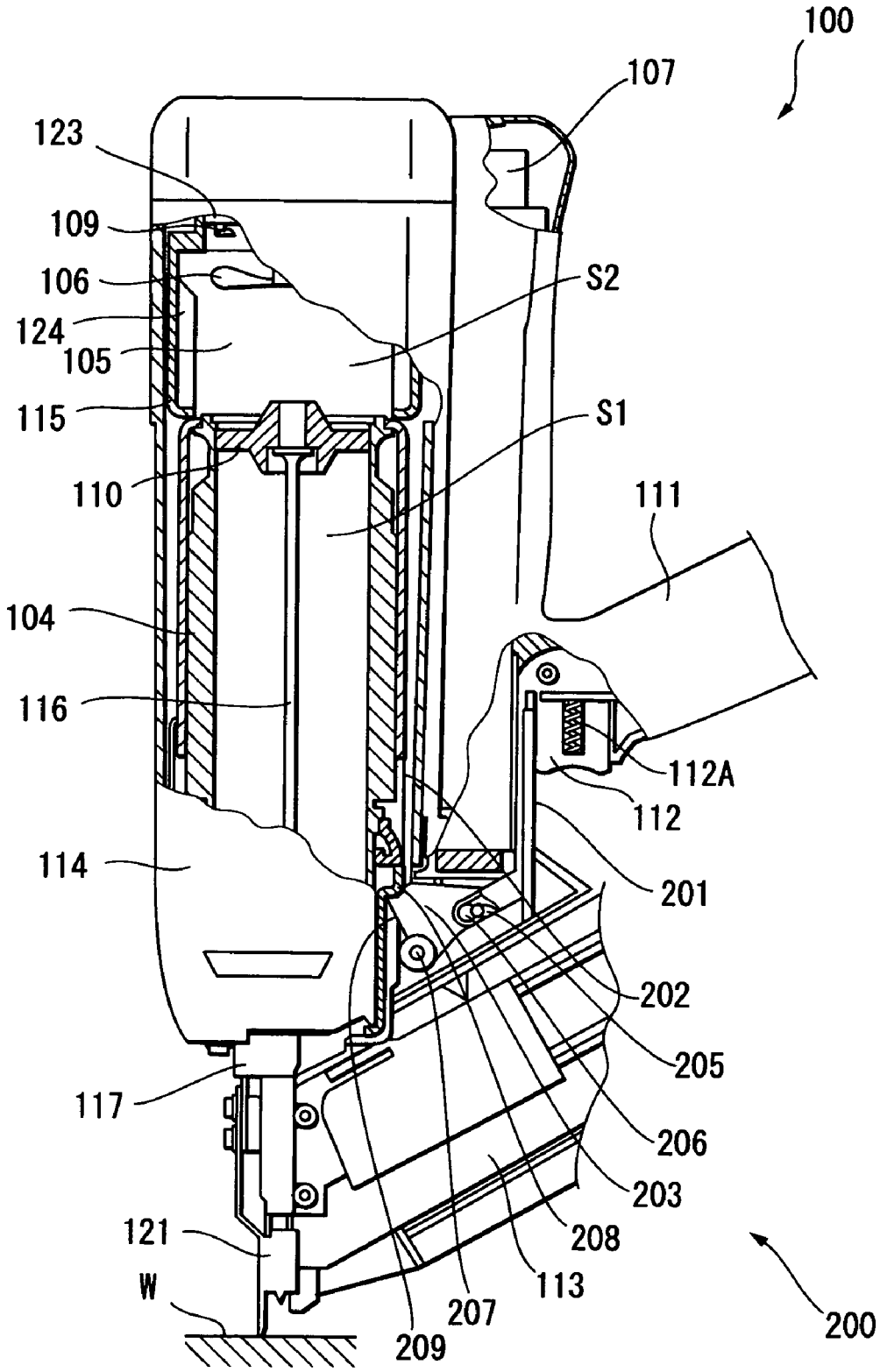
FIG. 1 PRIOR ART
FIG. 1 is a partial cross-sectional view showing a conventional combustion-powered nail gun.

A structure of a combustion-powered nail gun 1 is almost the same as that of the conventional nail gun 100 shown in FIG. 1. The nail gun 1 includes a housing 14, a head cover 23, a combustion chamber frame 15, ribs 24, a cylinder 4, a piston 10, a driver blade 16, a handle 11, a trigger switch 12, a magazine 13, a tail cover 17, a push lever 21, a fan 6, a motor 8, a spark plug 9, and fuel canister 7. All these elements are similar to those of the conventional nail gun 100 shown in FIG. 1. The combustion chamber frame 15, the head cover 23, and the piston 10 together define a combustion chamber 5. Further, the piston 10 divides the cylinder 4 into a lower chamber S1 and an upper chamber S2 inclusive of the combustion chamber 5. The combustion chamber frame 15 is connected to the push lever 21 through a connection rod (not shown) for providing interlocking movement therebetween. Incidentally, atmospheric pressure is applied to the lower chamber S1.

A spring (not shown) is provided for urging the push lever 21 downward. Therefore, the push lever 21 and the combustion chamber frame 15 are urged downwardly while no force operates against the urging force of the spring, as shown in FIG. 2A. In this state, an inlet passage 30 is provided between the head cover 23 and the upper end portion of the combustion chamber frame 15, and an outlet passage 25 is provided between the cylinder 4 and the lower portion of the combustion chamber frame 15.

An annular seal member 29 is disposed at the head cover 23 which can be in sealing contact with the upper part of the combustion chamber frame 15 for closing the inlet passage 30 when the push lever 21 is pressed against a workpiece W. Further, an annular seal member 28 is disposed at an upper outer peripheral portion of the cylinder 4 which can be in sealing contact with the lower part of the combustion chamber frame 15 for closing the outlet passage 25 when the push lever 21 is pressed against the workpiece W. Further, an intake vent (not shown) is provided in the upper end of the housing 14 and a discharge vent (not shown) is provided in the lower end of the housing 14.

An injection port 22 is open to the combustion chamber 5 and is fluidly connected to the canister 7. A seal ring 10A is held at an outer peripheral surface of the piston 10 so as to be slidably movable with respect to the cylinder 4. In the cylinder 4, a bumper 2 is provided below the piston 10 for absorbing excessive energy of the piston 10 after a nail driving operation. Also, exhaust holes 3 are formed in the cylinder 4, and check valves 31 is provided on the outer side of the exhaust holes 3. Further, a stop ring 40 is implanted in an upper inner peripheral surface of the cylinder 4 so that the piston 10 is abuttable against the stop ring 40 for preventing the piston 10 from its excessive movement during its return stroke. At the housing 14, a display 75 (FIG. 3) such as a LED is visibly provided for displaying driving state or drivable state of the nail gun 1.

A solenoid 51 is fixed to the outer surface of the housing 14. The solenoid 51 has a plunger 52 movable toward and away from the combustion chamber frame 15 and engageable with and releasable from the combustion chamber frame 15. The solenoid 51 is adapted for preventing the combustion chamber frame 15 from moving away from the head cover 23 so as to maintain thermal vacuum in the upper space S2.

A head switch 80 (FIG. 3) is provided within the housing 4 for detecting a timing at which the combustion chamber frame 15 reaches its upper stroke end position after the push lever 21 is pressed against the workpiece W for moving the push lever 21 toward the head cover 23. The cylinder 4 is formed with the exhaust hole 3, and a check valve 31. The check valve 31 is pivotally movable so as to selectively close the exhaust hole 3.

Figure 3:
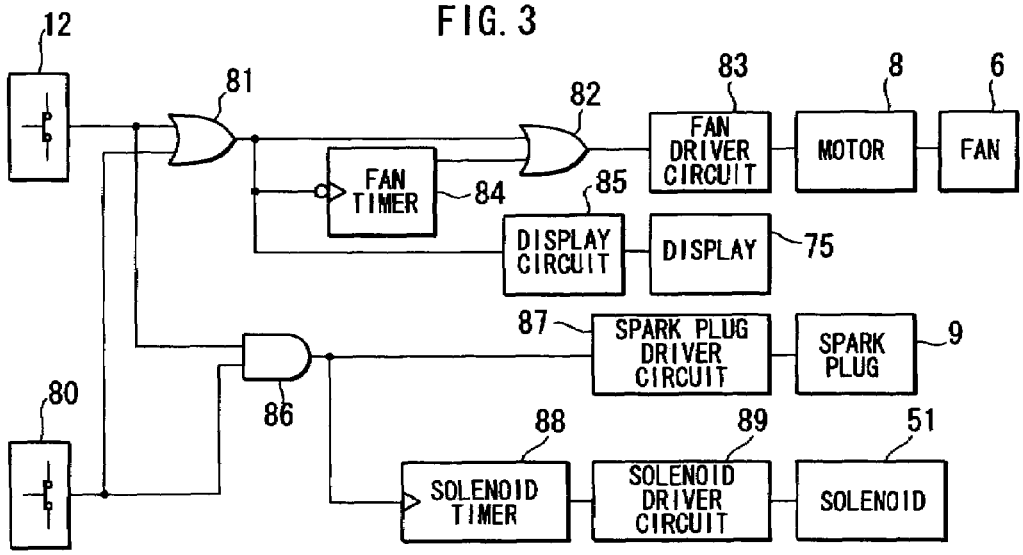
FIG. 3 is a block diagram showing an electrical circuit incorporated in the combustion-powered nail gun according to the first embodiment of the present invention.

FIG. 3 shows an electrical circuit equipped with the nail gun 1. The trigger switch 12 and the head switch 80 are connected to the inputs of a first OR gate 81 that is connected to a second OR gate 82. A fan driver circuit 83 is connected to the output of the second OR gate 82, and the motor 8 is in turn connected to the output of the fan driver circuit 83. The fan 6 is connected to the shaft of the motor 8. Therefore, the rotation of the fan 6 can be started upon turning ON at least one of the trigger switch 12 and the head switch 80.

Figure 4:
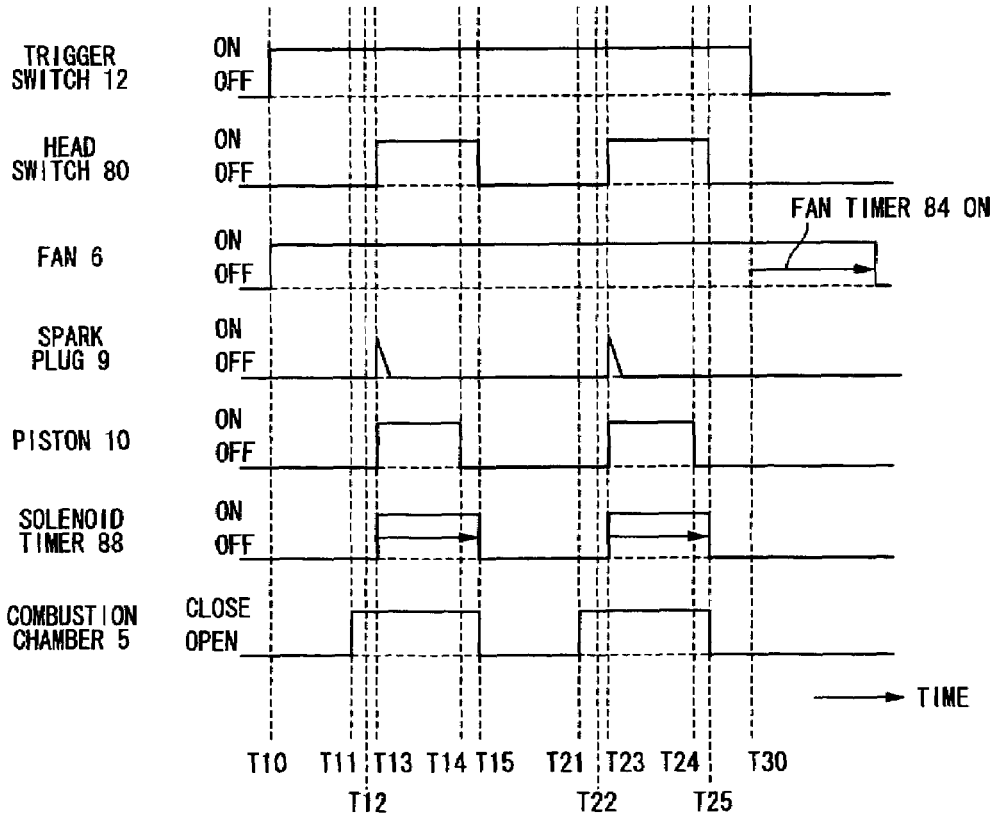
FIG. 4 is a timing chart showing operations of various components in the combustion-powered nail gun according to the first embodiment of the present invention.

A fan timer 84 is connected between the output terminal of the first OR gate 81 and a second input terminal of the second OR gate 82. The fan timer 84 is turned ON when both the trigger switch 12 and the head switch 80 are OFF states (T30 in FIG. 4). The rotation of the fan 6 is stopped after elapse of a predetermined period of time from the ON timing of the fan timer 84. A display circuit 85 is connected to the output terminal of the first OR gate 81, and the display 75 is connected to the display circuit 85. The display circuit 85 is turned ON when at least one of the trigger switch 12 and the head switch 80 is turned ON.

An AND gate 86 is connected to the trigger switch 12 and the head switch 80, and a spark plug 9 is connected through the spark plug driver circuit 87 to the output of the AND gate 86. Therefore, the spark plug 9 ignites when both the head switch 80 and the trigger switch 12 are turned ON irrespective of whether which switch is firstly turned ON.

A solenoid timer 88 is connected to the output terminal of the AND gate 86. The solenoid timer 88 is turned ON when both the head switch 80 and the trigger switch 12 are turned ON, and is turned OFF after elapse of a predetermined period of time (from T13 to T15 and from T23 to T25 in FIG. 4). The solenoid 51 is connected through a solenoid driver circuit 89 to the solenoid timer 88. The solenoid 51 is energized during ON state of the solenoid timer 88.

Next, operation of the nail gun 1 will be described. FIG. 2A shows the combustion-powered nail gun 1 with the combustion chamber frame 15 in the lowermost condition before a nail driving operation is performed. The solenoid 51 is deenergized so that the plunger 52 is in a retracted position where the combustion chamber frame 15 is not supported by the plunger 52. FIG. 2B shows the combustion-powered nail gun with the combustion chamber frame 15 in the uppermost condition. The solenoid 51 has been deenergized but will soon be energized so that the plunger 52 projects inwardly to support the combustion chamber frame 15. FIG. 2C shows the combustion-powered nail gun 1 that is on its way to the next driving position, wherein the combustion chamber frame 15 is held in the uppermost condition. Unlike the condition in FIG. 2A, the solenoid 51 is energized in FIG. 2C so that the plunger 52 is inwardly projected to support the combustion chamber frame 15.

When the nail gun 1 is held as shown in FIG. 2A, the combustion chamber frame 15 is in its lowermost position so that the inlet 30 is open between the combustion chamber frame 15 and the head cover 23 and the outlet 25 is open between the combustion chamber frame 15 and the cylinder 4. Also, the piston 10 is in its top dead position before a nail driving operation starts.

To prepare to drive a nail into a workpiece W, the user grips the handle 11 and presses the push lever 21 against the workpiece W. As a result, the push lever 21 rises upward against the urging force of the spring and the combustion chamber frame 15 connected to the push lever 21 moves upward. When the combustion chamber frame 15 moves upward in this manner, the inlet 30 and the outlet 25 are closed to provide a sealed combustion chamber 5 with the seal rings 29 and 28. Further, the head switch 80 is turned ON when the sealed condition of the combustion chamber 5 is detected. In synchronism with the ON timing of the head switch 80, the fan 6 starts rotating.

As a result of upward travel of the combustion chamber frame 15, the fuel canister 7 is pressed and supplies combustible gas to the injection port 22, which injects the combustible gas into the combustion chamber 5. The injected combustible gas and air in the combustion chamber 5 are agitated and mixed together by rotation of the fan 6 in the sealed off combustion chamber 5 and influence of the ribs 24 that protrude into the combustion chamber 5.

Next, the user pulls the trigger switch 12 on the handle 11 to generate a spark at the spark plug 9. The spark ignites and explodes the fuel/air mixture in the combustion chamber 5. The combustion, explosion and expansion of the air/fuel mixture drives the piston 10 and the driver blade 16 downward to drive the nail that is set in the tail cover 17 into the workpiece W.

During movement of the piston 10 toward its lower dead center, the piston 10 moves past the exhaust hole 3 so that the combustion gas in the upper space S2 is discharged outside of the cylinder 4 through the exhaust hole 3 and the check valve 31 until the pressure in the upper space S2 reaches atmospheric pressure, whereupon the check valve 31 in the exhaust hole 3 closes shut. Finally, the piston 10 strikes against the bumper 2 whereupon the piston 10 bounds as a result of impingement onto the bumper 2.

During this period, the inner surface of the cylinder 4 and the inner surface of the combustion chamber frame 15 absorb heat of the combusted gas so that the combusted gas rapidly cools and contracts. Therefore, after the check valve 31 closes, pressure in the upper chamber S2 decreases to below atmospheric pressure. This is referred to as a thermal vacuum. This thermal vacuum pulls the piston 10 back to the upper dead position because of the pressure difference between the upper chamber S2 and the lower chamber S1. The plunger 52 of the solenoid 51 maintains pull out position to engage the combustion chamber frame 15 for maintaining the combustion chamber frame 15 in its sealed position so as to maintain thermal vacuum in the upper chamber S2 until the piston 10 returns to its original upper dead center.

After the nail is driven into the workpiece W, the user releases the trigger switch 12 and lifts the nail gun 1 upward away from the workpiece W. When the push lever 21 separates from the workpiece W, the spring (not shown) urges the push lever 21 and the combustion chamber frame 15 back into the positions shown in FIG. 2A. Even after the trigger switch 12 is released and turned off, the fan 6 maintains rotation for a fixed period of time to scavenge the combusted gas in the combustion chamber 5. That is, in the condition shown in FIG. 2A, the inlet 30 and the outlet 25 are opened up above and below the combustion chamber frame 15 respectively. The combusted gas in the combustion chamber 5 is scavenged by rotation of the fan 6, which generates an air flow that draws clean air in through the intake vent (not shown) and that exhausts combusted gas from the discharge vent (not shown). After the scavenging operation, the fan 6 is stopped.

Operation of the successive-shot driving of the nails will be described with reference to FIGS. 2A–2C, 3 and 4. In order to perform the successive-shot driving from the state shown in FIG. 2A, when the trigger switch 12 is turned ON at timing T10, the fan 6 starts rotating. When the push lever 21 is subsequently urged against the workpiece W, the combustion chamber frame 15 makes upward movement to provide the sealed off combustion chamber 5 as shown in FIG. 2B, with the result that the head switch 80 is turned ON at timing T13. Then, the spark ignites and explodes the fuel/air mixture in the combustion chamber 5. The combustion, explosion and expansion of the air/fuel mixture drives the piston 10 and the driver blade 16 downward to drive the nail that is set in the tail cover 17 into the workpiece W.

At timing T13 when the spark ignites and explodes the fuel/air mixture in the combustion chamber 5, the solenoid 51 is energized by the solenoid driver circuit 89 for a predetermined period of time (from T13 to T15 and from T23 to T25 in FIG. 4) measured by the solenoid timer 88. During this period of time, the plunger 52 projects toward the combustion chamber frame 15 and the combustion chamber frame 15 is maintained in the upper dead center.

In order to subsequently drive of the next nail to a different location of the workpiece W, the nail gun 1 is moved away from the workpiece W. By virtue of the plunger 52 inwardly projected to hold the combustion chamber frame 15, the latter does not move downward against the biasing force of the spring but provides the sealed combustion chamber 5, as shown in FIG. 2C.

While the combustion chamber 5 maintains its sealed condition, the thermal vacuum pulls the piston 10 back to the upper dead center. The predetermined period of time at which the solenoid timer 88 is turned ON is set slightly longer than a period of time when the piston 10 returns to the upper dead center. Generally, the predetermined period of time at which the solenoid timer 88 is turned ON is set to 100 milliseconds or so, although this duration of time varies depending on the power of the nail gun 1.

Upon expiration of the predetermined period of time measured by the solenoid timer 88, the solenoid 51 is deenergized. As a result, the plunger 52 is retracted and disengaged from the combustion chamber frame 15. Accordingly, the combustion chamber frame 15 and the push lever 21 move downward by the biasing force of the spring. The combustion chamber 5 is open to atmosphere and the combusted gas is expelled out to the combustion chamber 5 and fresh air is introduced thereinto by the fan 6.

As described, the solenoid 51 serves to delay the timing (T15 and T25) at which the combustion chamber 5 is opened to atmosphere with respect to the timing (T14 and T24) at which the piston returns to the upper dead center, thereby ensuring the return of the piston 10 to its upper dead center by the thermal vacuum.

Because the timing at which the combustion chamber 5 is opened to atmosphere is delayed by virtue of the solenoid 51, more reliable one-shot driving operation can be performed even if the trigger switch 12 is released at a timing earlier than the relevant timing. However, if the solenoid 51 were not provided and if the combustion chamber 5 were opened to atmosphere resulting from the earlier release of the trigger switch 12, the internal pressures of the upper chamber S2 and the lower chamber S1 would be balanced before the piston 10 reaches the upper dead center. As such, the subsequent nail driving operation would not be performed adequately if the operation is stared from such a condition where the piston 10 is positioned below the upper dead center.

Figure 5:
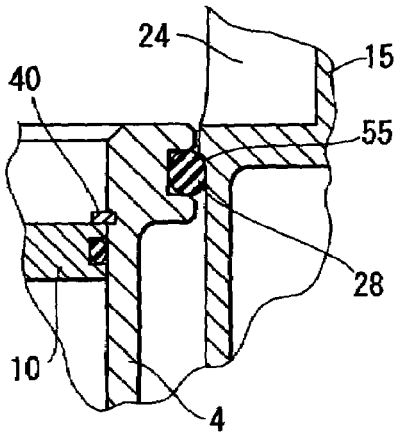
FIG. 5 is a partial enlarged cross-sectional view showing another example for delaying the timing at which the combustion chamber is opened to atmosphere.
Figure 6:
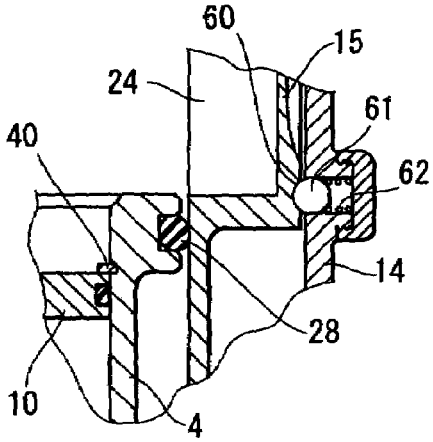
FIG. 6 is a partial enlarged cross-sectional view showing still another example for delaying the timing at which the combustion chamber is opened to atmosphere.
Figure 7:
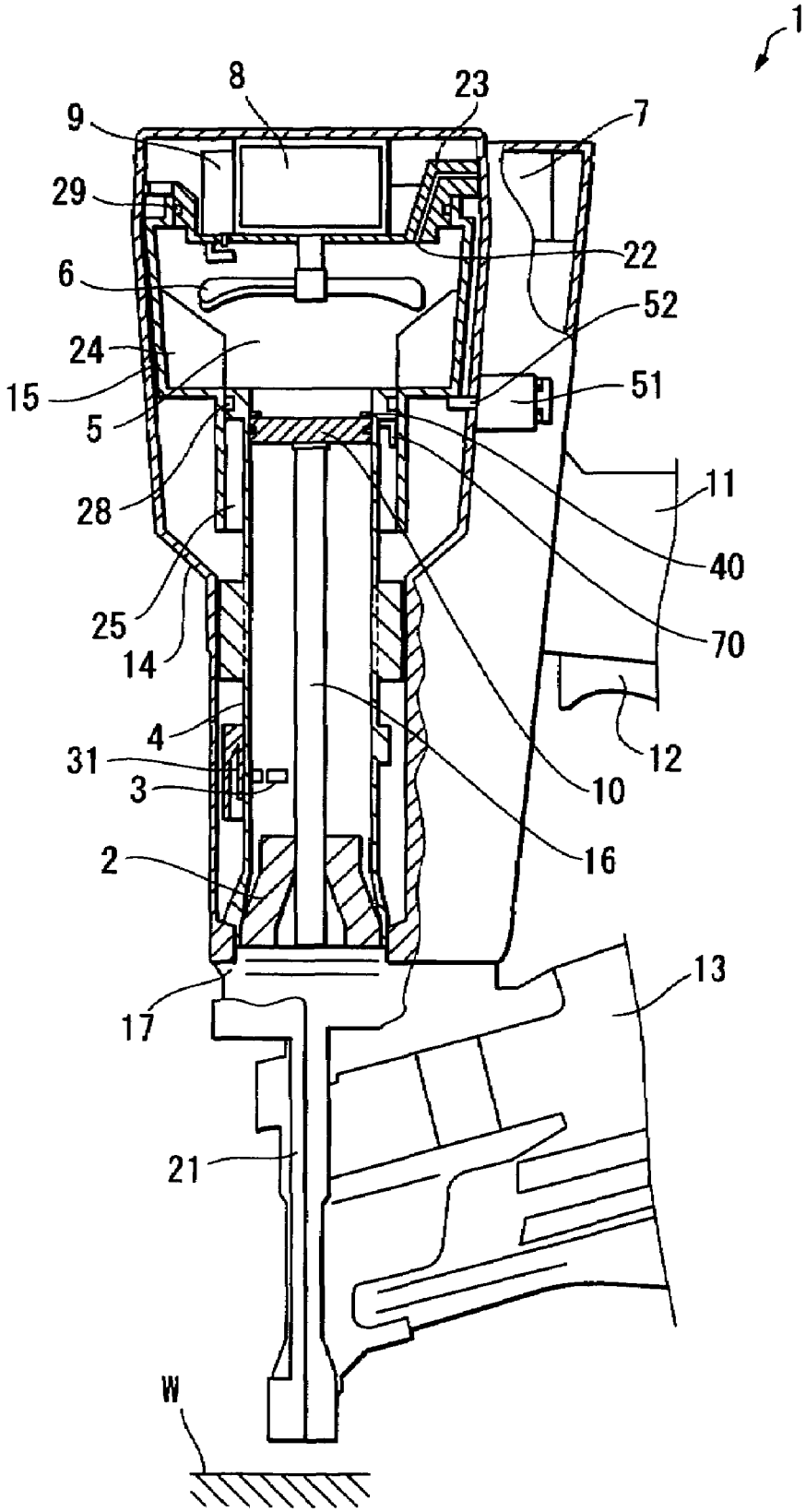
FIG. 7 is a partial cross-sectional view showing a combustion-powered nail gun according to a modification of the first embodiment of the present invention wherein the plunger is projected inwardly, thereby preventing the combustion chamber frame from lowering.

FIGS. 5 to 8 show another examples for delaying the timing at which the combustion chamber 5 is opened to atmosphere. The examples shown in FIGS. 5 and 6 do not employ the solenoid 51 and the plunger 52 as shown in FIGS. 2A–2C but employ other measures. The example shown in FIG. 7 is a modification of the embodiment shown in FIGS. 2A–2C.

FIGS. 5 and 6 are partial cross-sectional views showing the cylinder 4 and the annular seal member 28 when the combustion chamber frame 15 is in the upper dead center. In the example shown in FIG. 5, the combustion chamber frame 15 has an inner wall along which the annular sealing member 28 slidably moves. The inner wall of the combustion chamber frame 15 is formed with a stepped up portion 55 which bothers and thus delays the downward movement of the combustion chamber frame 15.

In the example shown in FIG. 6, the combustion chamber frame 15 has an outer wall formed with a groove 60. The housing 14 has an engagement member 61 that is engageable with and disengageable from the groove 60. The engagement member 61 is urged toward the combustion chamber frame 15 by a resilient member 62. With the engagement of engagement member 61 of the housing 14 with the groove 60 formed on the outer wall of the combustion chamber frame 15, the downward movement of the combustion chamber frame 15 is bothered and thus delayed.

In the example shown in FIG. 7, a piston detector 70 is disposed in a position near the upper dead center of the piston 10. The piston detector 70 detects that the piston 10 has returned to the upper dead center and outputs a detection signal. The solenoid 51 is deenergized in response to the detection signal.

Figure 8:
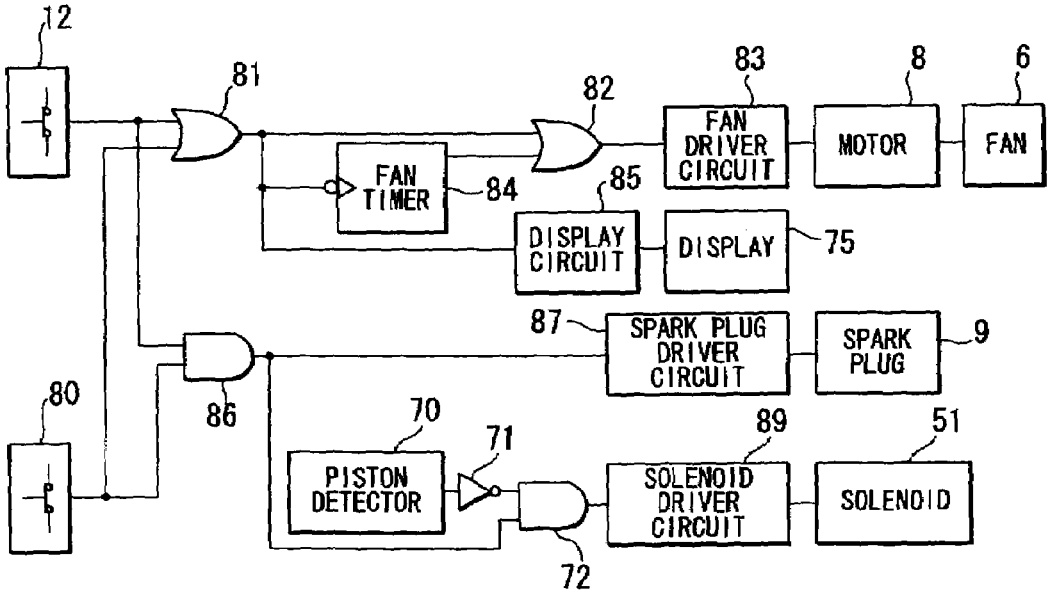
FIG. 8 is a block diagram showing a control circuit incorporated in the combustion-powered nail gun according to the modification of the first embodiment shown in FIG. 7.

FIG. 8 is an electrical circuit for implementing the example shown in FIG. 7. The configuration of the electrical circuit in FIG. 8 is similar to that of the electrical circuit shown in FIG. 4 but is different therefrom in the provision of the piston detector 70, an inverter 71 connected to the output of the piston detector 70, and an AND gate 72 having a first input connected to the output of the inverter 71 and a second input connected to the output of the AND gate 86. The output of the AND gate 72 is connected to the solenoid driver circuit 89 and the solenoid 51 is connected to the output of the solenoid driver circuit 89.

In operation, when both the trigger switch 12 and the head switch 80 are turned ON, the AND gate 86 is enabled. In this condition, when the piston detector 70 does not detect the piston 10, that is, when the piston 10 has not yet reached the upper dead center, then the output of the piston detector 70 is applied to the first input of the AND gate 72 upon being inverted by the inverter 71. Therefore, the AND gate 72 is enabled, thereby driving the solenoid driver circuit 89 to energize the solenoid 51. In this manner, when the piston 10 has not yet reached the upper dead center, the solenoid 51 is energized to project the plunger 52 inwardly. Therefore, the combustion chamber frame 15 is supported by the plunger 52 so as not to lower from the uppermost position. On the other hand, when the piston detector 70 detects the piston 70 under the condition where both the trigger switch 12 and the head switch 80 are turned ON, then the solenoid 51 is deenergized, so that the combustion chamber frame 15 is no longer supported by the plunger 52.

The position detector 70 may optically, magnetically or ultrasonically detect the arrival of the piston 10. Further, an acceleration sensor may be used as the position detector 70. In this case, the solenoid driver circuit 89 is energized when the acceleration sensor detects vibrations occurring when the piston 10 is brought into abutment with the stop ring 40 when the piston 10 is moved back to the upper dead center.

Figure 9:
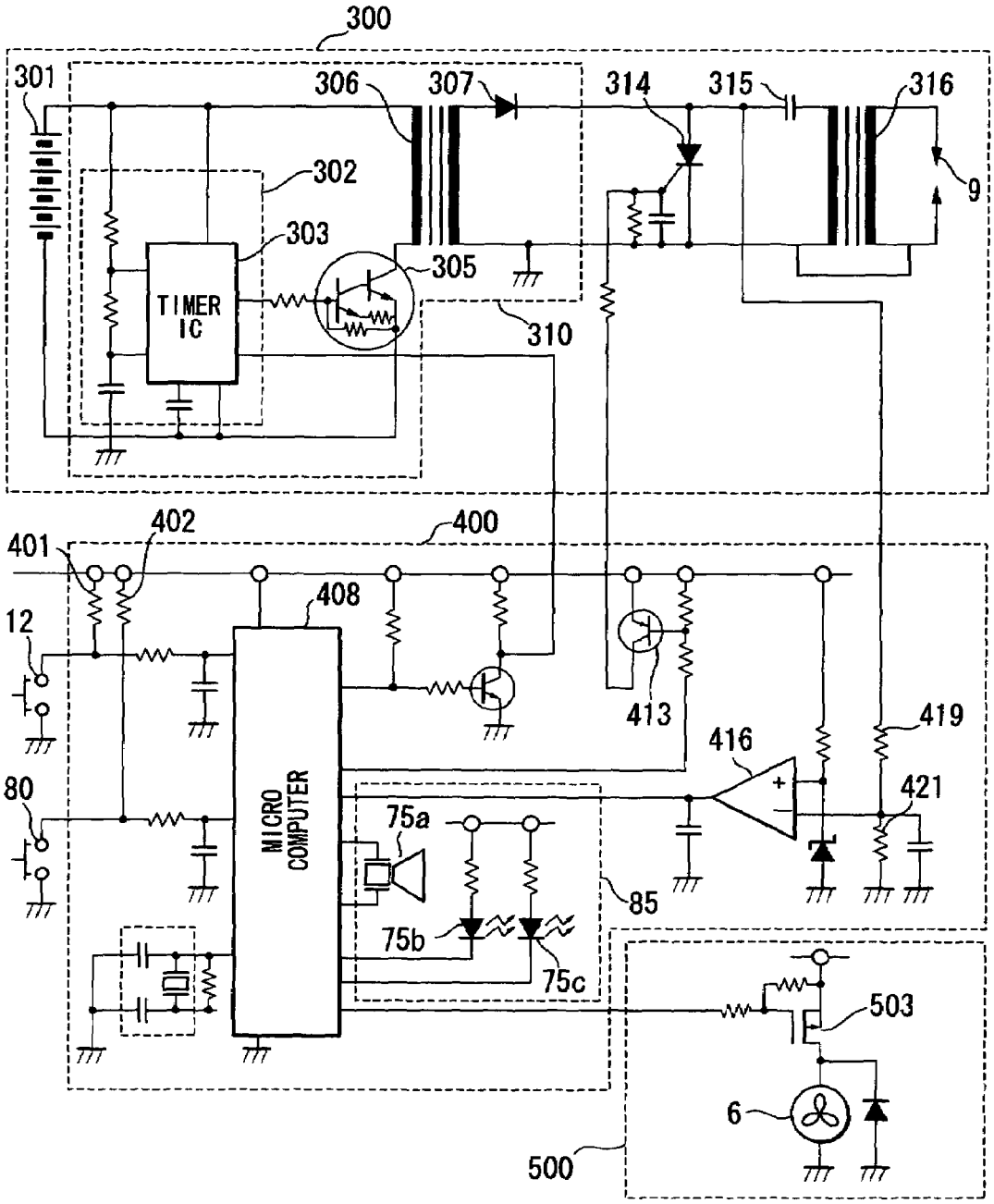
FIG. 9 is a block diagram showing an ignition system used in the combustion-powered nail gun according to a second embodiment of the present invention.

Next, an ignition system according to an embodiment of the invention will be described while referring to FIG. 9. The ignition system includes an ignition circuit 300, a control circuit 400, a fan control circuit 500, a head switch 80, and a trigger switch 12.

The ignition circuit 300 includes a battery 301, a first stage boosting circuit 310, a capacitor 315, a thyristor 314, and a second stage high-voltage transformer 316. Although not shown in the drawing, a three-terminal regulator is connected to the battery 301 to produce DC voltages to be supplied to the control circuit 400, the fan circuit 500 and a display circuit 85 provided in the control circuit 400. The boosting circuit 310 includes a transformer 306 having a primary winding connected to a switching transistor 305. An oscillation circuit 302 including a timer IC 303 is connected to the switching transistor 305 so that the switching transistor 305 performs switching actions in response to the pulses output from the oscillation circuit 302.

The diode 307, the thyristor 314 and the capacitor 315 are connected between the secondary winding of the transformer 306 and the primary winding of the high-voltage transformer 316. The spark plug 9 is connected across the secondary winding of the transformer 316.

The control circuit 400 includes a microcomputer 408, a comparator 416 for comparing the voltage developed across the capacitor 315 has exceeded a predetermined voltage, and the display circuit 85 for visually and audibly alerting conditions of the nail gun to an operator.

The trigger switch 12 and the head switch 80 are connected through pull-up resistors 401 and 402 to the voltage line of the control circuit 400, respectively. These switches 12 and 80 are also connected to the input ports of the microcomputer 408. The microcomputer 408 has output ports connected to the display circuit 85, the oscillation circuit 302, the thyristor 314, and the fan control circuit 500. The display circuit 85 includes a buzzer 75*a*, and LEDs 75*b* and 75*c*.

The fan control circuit 500 is provided for controlling the fan 6 used to agitate combustible gas confined in the combustion chamber 5. The fan control circuit 500 includes an FET 503 having a gate connected to the output port of the microcomputer 408.

In operation, the voltage produced by the first stage boosting circuit 310 is applied to the capacitor 315, whereby the capacitor 315 accumulates electric charges therein. The comparator 416 compares the voltage across the capacitor 315 with the predetermined voltage and outputs the comparison results to the microcomputer 408. When the microcomputer 408 learns that the voltage across the capacitor 315 has exceeded the predetermined voltage, it outputs a signal to render a transistor 413 conductive, whereby the thyristor 314 is triggered and rendered conductive. When the thyristor 314 is rendered conductive, the charges in the capacitor 315 are rapidly discharged through the primary winding of the high-voltage transformer 316, thereby generating a high voltage at the secondary winding of the transformer 316. As a result, spark occurs in the spark plug 9 and the combustible gas in the combustion chamber 5 is ignited.

Figure 10A:
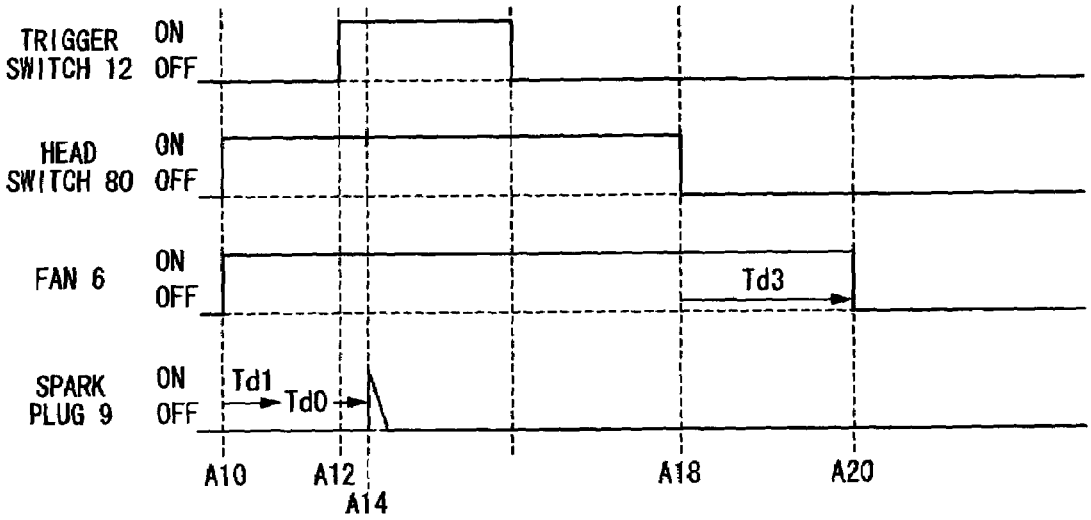
FIG. 10A is a timing chart for illustrating one-shot driving operations to be performed by the microcomputer shown in FIG. 9.
Figure 10B:
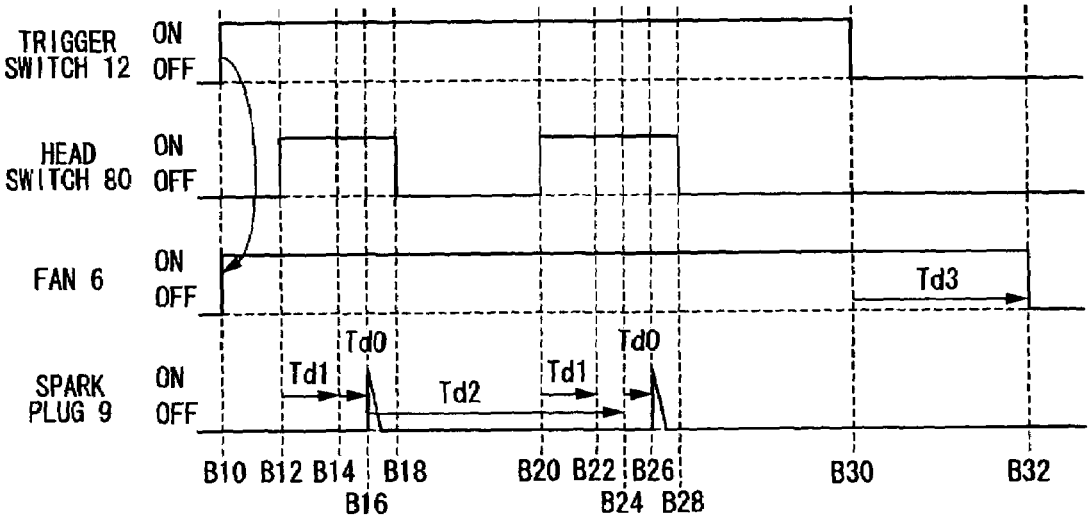
FIG. 10B is a timing chart for illustrating successive-shot driving operations to be performed by the microcomputer shown in FIG. 9.

Next, a software control of the ignition system shown in FIG. 9 will be described while referring to the timing charts shown in FIGS. 10A and 10B and also the flowchart shown in FIG. 11. In the timing charts of FIGS. 10A and 10B, Td0 denotes a driving period of time of the oscillation circuit 302; Td1, a period of time measured by a delay timer; Td2, a period of time measured by a successive-shot driving timer; and Td3, a period of time measured by a fan timer. It should be noted that all these timers are implemented by the microcomputer 408 having a time measuring function.

Figure 11:
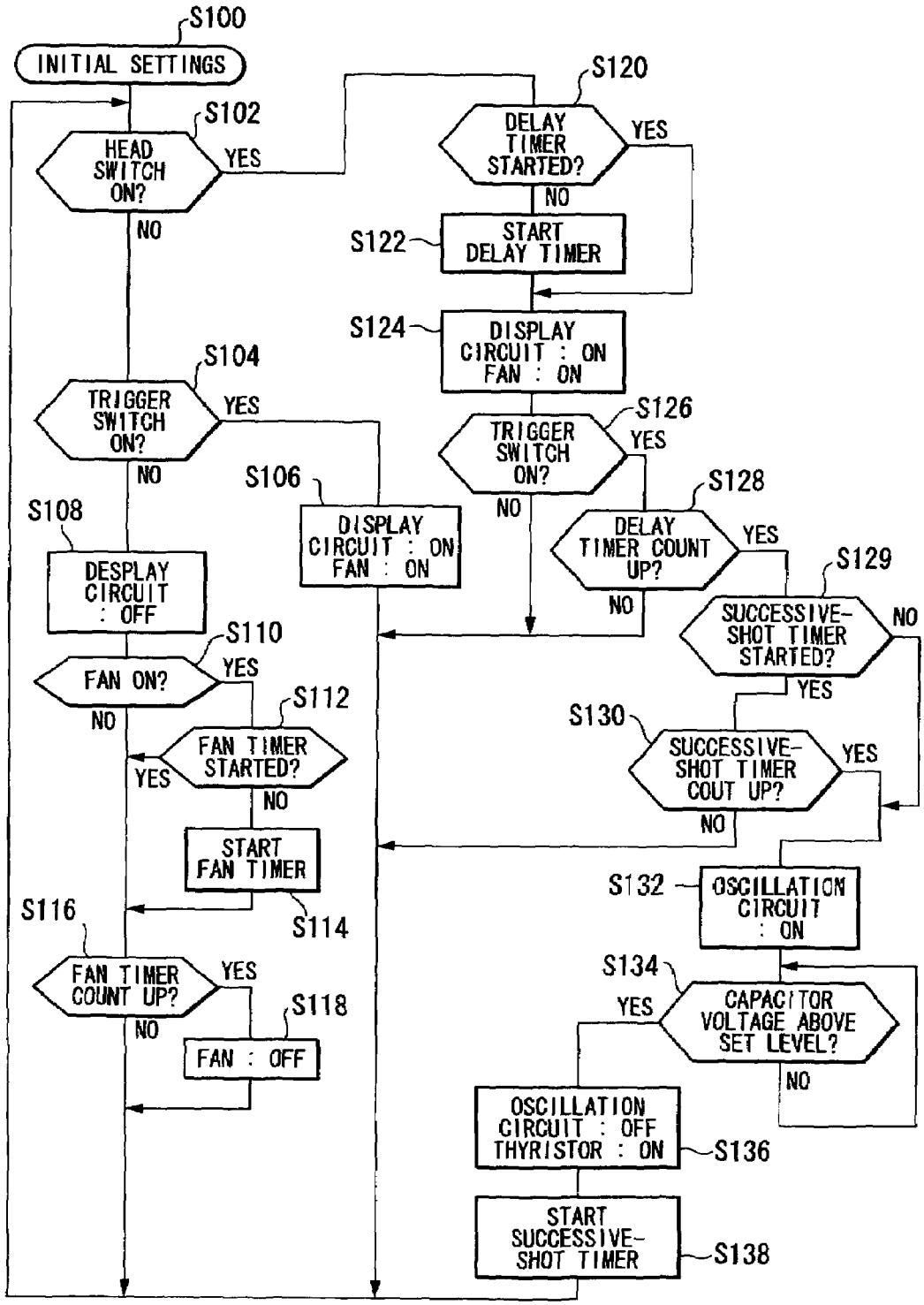
FIG. 11 is a flow chart for illustrating operations of the microcomputer incorporated in the ignition system shown in FIG. 9.

In the flowchart of FIG. 11, when the ignition system is powered, initial settings are executed by resetting the microcomputer 408 (S100). In this condition, the fan timer is in a count-up condition, i.e., the fan timer is placed in a condition where the set time is up, in order to prevent accidental rotations of the fan 6. The remaining timers are reset to zero (0). In S102, it is determined whether or not the head switch 80 is turned ON. If the head switch 80 has not yet been turned ON (S102: NO), then it is determined whether the trigger switch 12 is turned ON (S104) If the trigger switch 12 has not yet been turned ON (S104: NO), that is, when neither the head switch 80 nor the trigger switch 12 has been turned ON, the display circuit 85 is turned OFF (S108).

Afterward, the routine returns to S102 upon checking operations of the fan 6 and the fan timer in S108 and S110. Specifically, after turning OFF the display circuit 85, it is determined whether the fan 6 is driven (S110). When the fan 6 has been driven (S110: YES), then it is further determined whether the fan timer has been started (S112). If the fan timer has not yet been started (S112: NO), the fan timer is started (S114). When it is confirmed that the fan timer has been started (YES in S112, S114), it is determined whether the fan timer is in a counted-up condition (S116). That is, when the fan timer has measured the period of time Td3, then the fan 6 is turned OFF (S118), whereupon the routine returns to S102. If the fan timer has not yet measured the period of time Td3 (S116: NO), the routine returns to S102 and repeats the processes in S104, S108, S110, S112 and S116 until the period of time Td3 is measured.

Next, one-shot driving operation will be described while referring further to the timing chart of FIG. 10A.

When determination made in S102 indicates that the head switch 80 has been turned ON (S102: YES) at timing A10, the delay timer is started to measure the period of time Td1 (S120, S122). In coincidence with the start of the delay timer, the display circuit 85 and the fan 6 are also driven (S124). Measurement of the period of time Td1 by the delay timer is needed to preserve a time necessary for the fan 6 to mix up air and gaseous fuel within the combustion chamber 5. The period of time Td1 is set, for example, to 50 to 100 milliseconds.

When the trigger switch 12 is turned ON at timing A12 after the head switch 80 has been turned ON (S126: YES), then the oscillation circuit 302 is driven (S132) if the delay timer is in a counted-up condition (S128). Typically, the measurement of the period of time Td1 by the delay timer will end before the trigger switch 12 is turned ON, because the period of time Td1 is sufficiently short as compared with a period of time from the ON timing of the head switch 80 at timing A10 to the subsequent ON timing of the trigger switch 12 at timing A12.

Because the successive-shot timer has not yet been started (S129: NO), the oscillation circuit 102 is driven at timing A14 just after the trigger switch 12 is turned ON. As a result, the voltage generated at the secondary winding of the transformer 306 is applied to the capacitor 315. The voltage across the capacitor 315 is detected by the resistors 419 and 421 and is compared with the predetermined voltage in the comparator 416. When the comparator 416 outputs a signal to the microcomputer 408 to indicate that the voltage across the capacitor 315 has exceeded the predetermined voltage (S134: YES), driving of the oscillation circuit 302 is stopped. At the same time, the thyristor 114 is triggered (S136). As a result, the spark plug 9 generates a spark and the combustible gas is ignited.

After ignition, the successive-shot timer starts measuring the period of time Td2 (S138), whereupon the routine returns to S102 and repeats the processes in S120, S122, S124, S126 and S128. Because the successive-shot timer has been started (S129: YES), it is determined whether the successive-shot timer is in a counted up condition (S130). When the successive-shot timer is has measured a period of time Td2 (S130: YES), the oscillation circuit 302 is driven. Stated differently, the oscillation circuit 302 is not driven before expiration of the period of time Td2 measured by the successive-shot timer. This means that ignition to the combustible gas is prohibited at least during the period of time Td2 measured by the successive-shot timer.

Next, the successive-shot driving operation will be described while referring to the timing chart of FIG. 10B and also the flow chart of FIG. 11.

When the trigger switch 12 is turned ON (S104) at timing B10, both the display circuit 85 and the fan 6 are driven (S106). When the nail gun 1 is brought into abutment with the workpiece W, the head switch 80 is turned ON (S102) at timing B12, whereupon the delay timer starts measuring a period of time Td1 (S122). When the delay timer has measured the period of time Td1 (S128) at timing B14, the oscillation circuit 102 is driven (S132) at timing B16. When the voltage across the capacitor 315 exceeds the predetermined voltage (S134: YES), the thyristor 314 is turned ON (S136), thereby igniting combustible gas. Because the ignition timing is delayed by the period of time Td1 measured by the delay timer, fuel injected after the head switch 80 is turned ON is well mixed with air before ignition is taken place.

Concurrently with the ignition, the successive-shot timer starts measuring a period of time Td2 (S138). When the nail gun 1 is moved away from the workpiece W, the head switch 80 is turned OFF. This occurs at timing B18. When the operator again brings the nail gun 1 into abutment with the workpiece W for another nail driving operation to a different location of the workpiece W, the head switch 80 is again turned ON (S102) at timing B20. At the same time, the delay timer starts measuring a period of time Td1 (S122). Even if the delay timer has measured the period of time Td1, the oscillation circuit 302 is not driven if the successive-shot timer has not yet measured the period of time Td2. When the successive-shot timer has measured the period of time Td2 (S130: YES) at timing B24, then the oscillation circuit 302 is turned ON (S132) at timing B26. When the voltage across the capacitor 315 has exceeded the predetermined voltage (S134: YES), the thyristor 314 is turned ON and the spark plug 9 generates a spark, thereby igniting the combustible gas confined in the combustion chamber 5.

The period of time Td2 needs to be preserved for allowing the piston 10 to move downward to the lower dead center and then move upward to the upper dead center and also for allowing the exhaust gas in the combustion chamber to be replaced with fresh air. If ignition is taken place before expiration of this period of time Td2, the ignition may result in failure.

Generally, the period of time Td1 measured by the delay timer is set to 10 to 50 milliseconds, the period of time Td2 measured by the successive-shot timer to 10 to 300 milliseconds, and the period of time Td3 measured by the fan timer to 5 to 15 seconds. It should be noted that the above-noted time durations are merely examples and the invention is not limited thereto.

Figure 12:
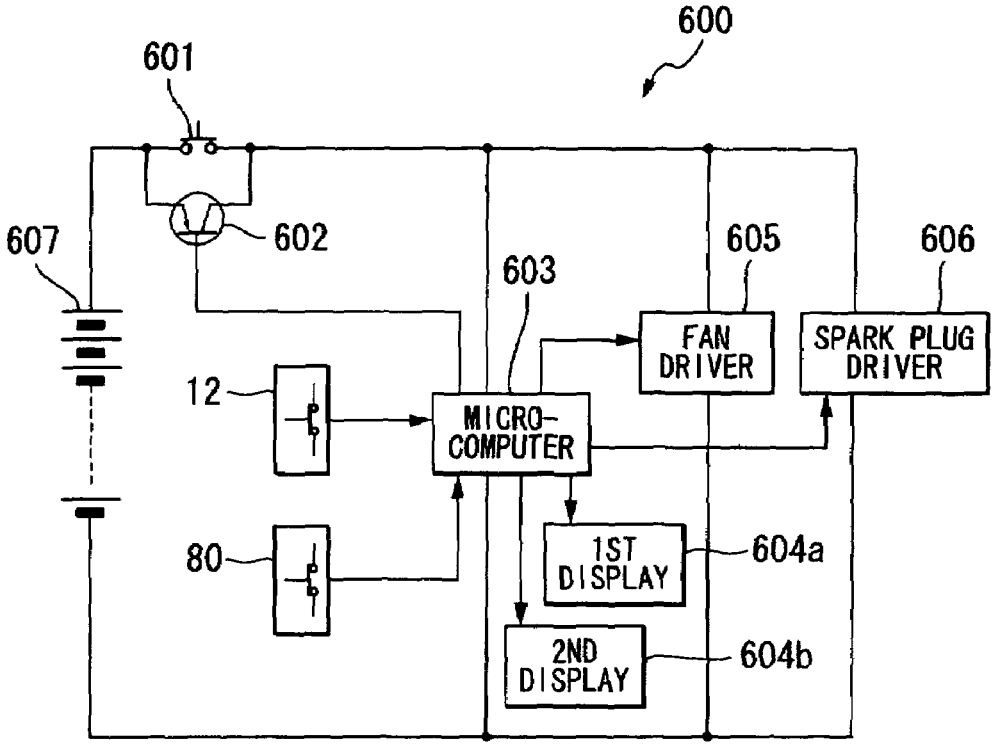
FIG. 12 is a block diagram showing a drive control circuit of the combustion-powered nail gun according to the third embodiment of the present invention.

Next, a third embodiment of the present invention will be described while referring to FIGS. 12 and 13. FIG. 12 is a block diagram showing a drive control circuit of a combustion-powered nail driving tool according to the third embodiment of the invention. A mechanical arrangement of the tool is basically same as that shown in FIGS. 2A through 2C or FIG. 7, so the same reference numerals will be used to refer to the same components. Unlike the tool previously described, the tool according to the third embodiment is equipped with the safety switch 601.

As shown in FIG. 12, the drive control circuit 600 includes a fan driver circuit 605 for driving the fan 6, a spark plug driver circuit 606 for driving the spark plug 9, a first display 604*a*, and a second display 604*b*, all of which are operatively connected to and controlled by a microcomputer 603. The microcomputer 603, the fan driver circuit 605, and the spark plug driver circuit 606 are connected in parallel with a battery 607.

The safety switch 601 is connected between the battery 607 and the microcomputer 603. The safety switch 601 used herein is a momentary type switch which is a mechanical switch having a momentary contact function. Specifically, the safety switch 601 has a toggle and contacts in which the toggle moves to close the contacts when depressed by the operator. The safety switch 601 is closed only during depression. A transistor 602 is connected across the safety switch 601 and is connected to and controlled by the microcomputer 603. The first and second displays 604*a* and 604*b* are provided for alerting the operator that operating conditions of the nail gun have been changed and/or will soon be changed. The displays 604*a* and 604*b* may include a speaker to audibly alert the change of the operating condition and/or a vibrator to give vibration to the operator to alert the change of the operating condition.

An off timer, a display timer, and a fan timer are provided internally of the microcomputer 603. All these times measure a duration of time by counting clock pulses generated from an oscillator (not shown). The off timer is provided for determining that the tool is not to be used any more. The off timer starts counting when both the trigger switch 12 and the head switch 80 are turned OFF. When the off timer counts up, the drive control circuit 600 will soon be shut down. The period of time measured by the off timer is preferably selected from a range between 5 to fifteen minutes. The display timer is provided for measuring a period of time during which the second display 604*b* indicates that the drive control circuit 600 is powered. The period of time measured by the display timer is preferably selected from a range between 1 to 10 seconds. The fan timer is provided for determining a period of time during which the fan 6 is driven, which is preferably selected from a range between 5 to 15 seconds.

Figure 14:
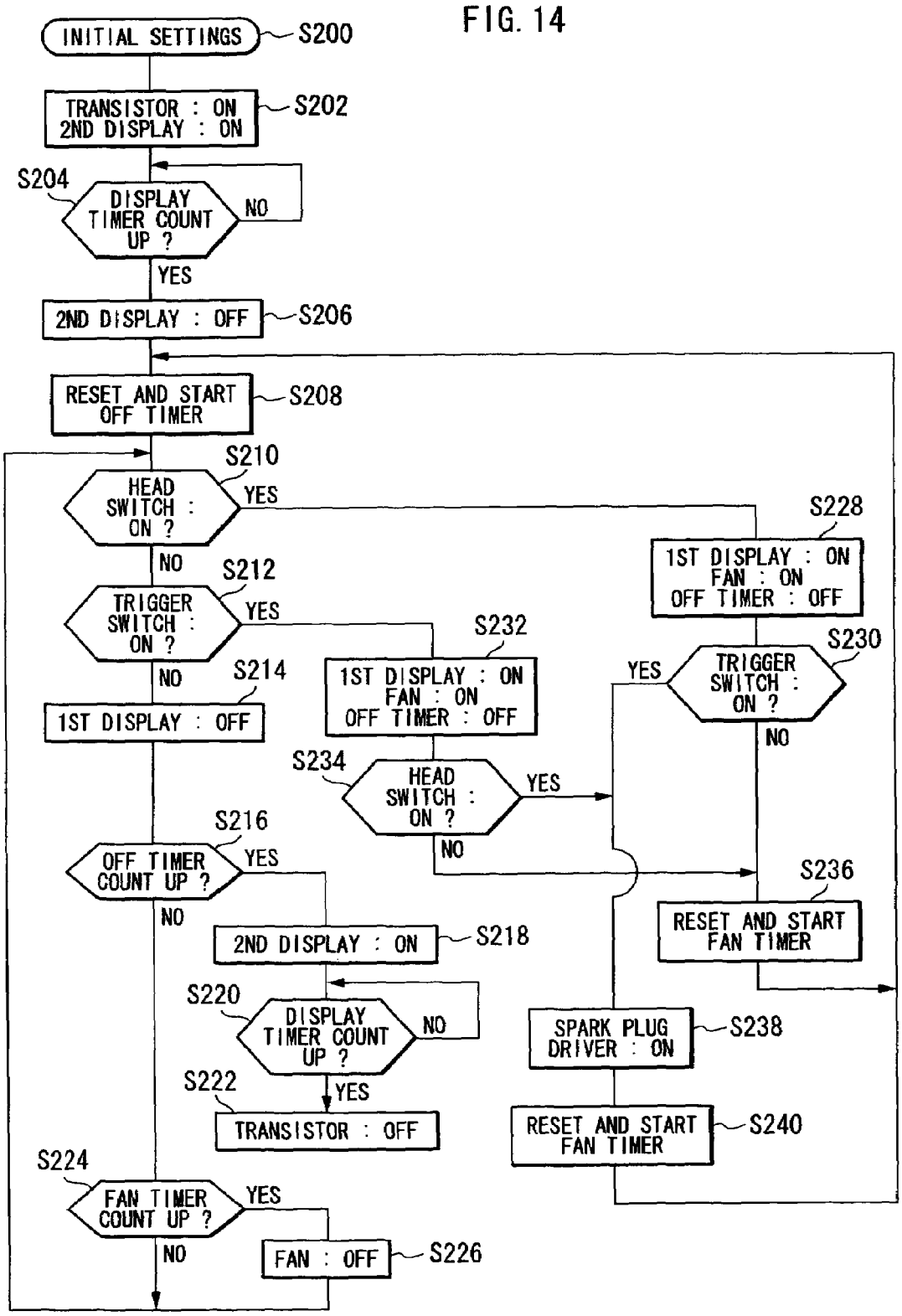
FIG. 14 is a flow chart for illustrating operations of the microcomputer incorporated in the drive control circuit shown in FIG. 12.

Next, operation of the microcomputer 603 will be described with reference to the flowchart shown in FIG. 14.

The microcomputer 603 is powered when the safety switch 601 is depressed by the operator, whereupon initial settings are performed (S200). The transistor 602 is supplied with an enabling signal from the microcomputer 603 and is rendered ON. At the same time, the second display 604*b* is turned ON (S202). In coincidence with the timing at which the transistor 602 is rendered ON, the display timer starts counting (S204) and the second display 604*b* indicates that the drive control circuit 600 is now powered. This indication continues until the display timer counts up. When the display timer counts up, the second display 604*b* is turned OFF (S206). Then, the operator can recognize that the drive control circuit 600 is powered, so can release the safety switch 601 to turn the latter OFF. After the safety switch 601 is turned OFF, the microcomputer 603, the fan driver circuit 605, and the spark plug driver circuit 606 are continuously supplied with power from the battery 607 through the transistor 602. Then, the off timer is reset and started (S208).

When the head switch 80 is turned ON (S210), the first display circuit 604*a* and the fan driver circuit 605 are driven and the off timer is turned OFF (S228). The first display circuit 604*a* indicates that nail driving operation is ready to be performed. When the microcomputer 603 determines that the trigger switch 12 is turned ON under the condition where the nail driving operation is ready (S230:Yes), the spark plug driver circuit 606 is driven to perform the nail driving operation (S238). The nail driving operation is also performed when the trigger switch 12 and the head switch 80 are turned ON successively in the stated order.

After the nail driving operation is performed, the fan timer is reset and restarted (S240). Up to the time when the fan timer counts up, the fan 6 is driven. When both the head switch 80 and the trigger switch 12 are turned OFF (S210: NO and S212:NO), the first display circuit 104 is turned OFF (S214) and the microcomputer 603 determines whether or not the off timer counts up (S216). When the off timer counts up (S216:YES), then the second display 604*b* is turned ON (S218), thereby indicating that the driving control circuit 600 will soon be shut down. When the display timer counts up (S220:YES), the transistor 602 is rendered OFF (S222). As such, even if the tool is left unused while connecting the battery 607, the driver circuits are automatically disconnected from the battery 607. Accordingly, the battery 607 can be prevented from being over-discharged. Further, accidental ON of both the trigger switch 12 and the head switch 80 does not start the nail driving operation because the driver circuits are not powered. The nail driving operation can be resumed if the safety switch 101 is turned ON, as the microcomputer 603 is powered by turning the safety switch 101 ON.

When the count up condition of the off timer has not yet been reached (S216:NO), the microcomputer 603 determines whether or not the fan timer counts up (S224). If the fan timer counts up (S224:YES), then driving the fan driver circuit 605 is stopped to thereby stop the rotations of the fan 6.

A modification of the third embodiment shown in FIGS. 12 and 14 will be described with reference to FIG. 13. FIG. 13 shows a drive control circuit 600'. Used in this modification is a self-holding type safety switch 601' having a coil 608. When the safety switch 601' is turned ON by the operator, the microcomputer 603 is powered and the transistor 602 is rendered ON, with the result that a current flows in the coil 608 to energize the latter. With the energization of the coil 608, the contact of the safety switch 601' is held closed.

When both the trigger switch 12 and the head switch 80 are OFF for more than a predetermined period of time, the microcomputer 603 turns the transistor OFF to thereby deenergize the coil 608. Deenergization of the coil 608 opens the contact of the safety switch 601', thereby disconnecting the drive control circuit 600' from the battery 607.

Figure 13:
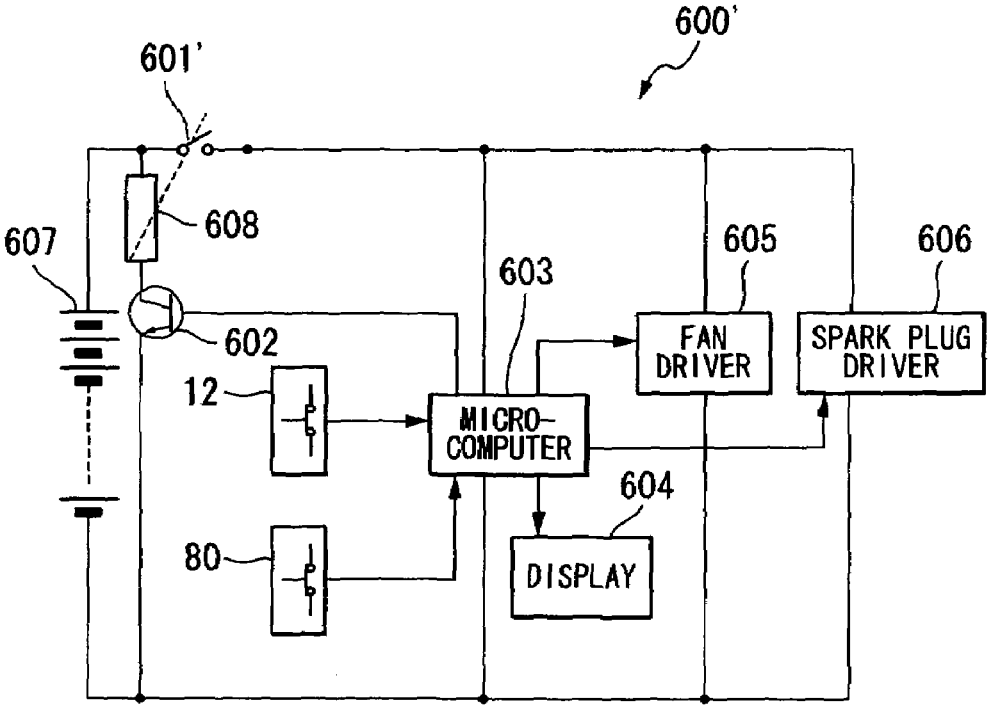
FIG. 13 is a block diagram showing a drive control circuit of the combustion-powered nail gun according to a modification of the third embodiment shown in FIG. 12.

An alternate ON/OFF type switch can be used instead of the safety switch 601' employed in the circuit shown in FIG. 13.

While the invention has been described in detail with reference to the specific embodiments thereof, it would be apparent to those skilled in the art that various changes and modifications may be made therein without departing from the spirit of the invention.

For example, in the second and third embodiments, the microcomputer is used. However, digital circuits may be used instead of the microcomputer. In the illustrated ignition system, a spark is generated when the voltage across the capacitor 315 has exceeded a predetermined voltage. This can be modified so as to discharge the capacitor 315 after expiration of a predetermined period of time from the start of charging the same.

What is claimed is:

1. A combustion-powered tool for driving a fastener into a workpiece, comprising:

a combustion chamber selectively opened to atmosphere and closed to be hermetically sealed, fuel being introduced into the hermetically sealed combustion chamber to fill the combustion chamber with a fuel/air mixture, the combustion chamber being formed of a combustion chamber frame movable to selectively open the combustion chamber to atmosphere and close the combustion chamber to be hermetically sealed;

a spark plug exposed to the combustion chamber for igniting the fuel/air mixture within the hermetically sealed combustion chamber, wherein inner pressure of the combustion chamber increases when the fuel/air mixture is ignited within the hermetically sealed combustion chamber;

a driver blade that is moved in accordance with the increase in the inner pressure of the combustion chamber, the fastener being driven into the workpiece caused by the increase in the inner pressure of the combustion chamber;

a first switch that is selectively turned ON or OFF, the first switch being turned ON when the combustion chamber frame has reached a predetermined position;

a second switch that is selectively turned ON or OFF, the second switch being turned ON when the second switch is manipulated by an operator; and a control unit that controls the spark plug to ignite the fuel/air mixture when both the first switch and the second switch are rendered ON irrespective of an order in which the first switch and the second switch are turned ON.

2. A combustion-powered tool for driving a fastener into a workpiece, comprising:

a combustion chamber selectively opened to atmosphere and closed to be hermetically sealed, fuel being introduced into the hermetically sealed combustion chamber, the combustion chamber being formed of a combustion chamber frame movable to selectively open the combustion chamber to atmosphere and close the combustion chamber to be hermetically sealed;

a fan rotatably disposed inside the combustion chamber for mixing the fuel with air to fill the combustion chamber with a fuel/air mixture;

a spark plug exposed to the combustion chamber for igniting the fuel/air mixture within the hermetically sealed combustion chamber, wherein inner pressure of the combustion chamber increases when the fuel/air mixture is ignited within the hermetically sealed combustion chamber;

a driver blade that is moved in accordance with the increase in the inner pressure of the combustion chamber, the fastener being driven into the workpiece caused by the increase in the inner pressure of the combustion chamber;

a first switch that is selectively turned ON or OFF, the first switch being turned ON when the combustion chamber frame has reached a predetermined position;

a second switch that is selectively turned ON or OFF, the second switch being turned ON when the second switch is manipulated by an operator;

a third switch that is selectively turned ON or OFF;

a battery connected to the fan and the spark plug and a control unit that controls the spark plug to ignite the fuel/air mixture when both the first switch and the second switch are turned ON while the third switch is turned ON.

3. The combustion-powered tool according to claim 2, wherein the control unit controls the spark plug to inhibit igniting the fuel/air mixture when the third switch is turned OFF.

4. The combustion-powered tool according to claim 2, wherein the third switch is connected between the battery and the control unit.

5. The combustion-powered tool according to claim 4, further comprising a timer that starts measuring a predetermined period of time when the third switch is ON and both the first switch and the second switch are OFF, wherein the third switch is turned OFF when both the first switch and the second switch do not turn ON during the predetermined period of time measured by the timer.

6. The combustion-powered tool according to claim 5, wherein the third switch is a self-holding switch that holds an ON condition until the third switch is turned OFF and holds an OFF condition until the third switch is turned ON.

7. The combustion-powered tool according to claim 2, further comprising a switching element connected across the third switch and a timer that starts measuring a predetermined period of time, wherein the third switch is a momentary operated mechanical switch that is momentarily turned ON when manipulated by an operator, the switching element is turned ON when the third switch is turned ON, and the timer starts measuring the predetermined period of time when the third switch is momentarily turned ON and both the first switch and the second switch are OFF, wherein the switching element is turned OFF when both the first switch and the second switch do not turn ON during the predetermined period of time measured by the timer.

8. The combustion-powered tool according to claim 2, further comprising alerting means for alerting an operator that an operating condition of the combustionpowered tool has been changed or will soon be changed.

9. The combustion-powered tool according to claim 8, wherein the alerting means visually alert the operator a change of the operating condition.

10. The combustion-powered tool according to claim 8, wherein the alerting means audibly alert the operator a change of the operating condition.

11. The combustion-powered tool according to claim 8, wherein the alerting means physically vibrates the operator to alert a change of the operating condition.

12. A combustion-powered tool for driving a fastener into a workpiece, comprising:

a housing having an upper end portion, a lower end portion, an inner surface, and an outer surface;

a push lever supported at the lower end portion of the housing;

a head cover disposed at the upper end portion of the housing;

a cylinder fixedly disposed in the housing and formed with an exhaust hole;

a piston slidably movably disposed in the cylinder and dividing the cylinder into an upper chamber and a lower chamber, the piston being movable toward its lower dead center and its upper dead center;

a combustion chamber frame disposed within the housing and movable in interlocking relation with the movement of the push lever to bring into contact with and out of contact from the head cover, wherein a combustion chamber is defined by the combustion chamber frame, the head cover, and the piston when the combustion chamber frame is in contact with the head cover;

a driver blade extending from the piston into the lower chamber, a fastener driving operation being performed by the driver blade in accordance with the movement of the piston toward the lower dead center;

a spark plug exposed to the combustion chamber for igniting a fuel/air mixture provided in the combustion chamber;

a first switch that is turned ON when the combustion chamber frame has reached a predetermined position and OFF when the combustion chamber frame is out of the predetermined position;

a second switch that is turned ON when manipulated by an operator and OFF when manipulation by the operator is stopped; and delaying means for delaying opening of the combustion chamber to atmosphere until the piston moves back to its upper dead center from its lower dead center.

* * * * *